United States Patent [19]

Farr et al.

[11] 4,350,062

[45] Sep. 21, 1982

[54] POWER TONG

[75] Inventors: Garth M. Farr, Kingwood, Tex.; Terence D. McCoy; Jiri Dlask, both of Edmonton, Canada

[73] Assignee: Farr Oil Tool, Inc., Houston, Tex.

[21] Appl. No.: 203,652

[22] Filed: Nov. 3, 1980

Related U.S. Application Data

[63] Continuation of Ser. No. 6,905, Jan. 26, 1979, abandoned.

[51] Int. Cl.[3] ..... B25B 17/00

[52] U.S. Cl. ..... 81/57.18

[58] Field of Search ..... 81/57.15, 57.18, 57.19, 81/57.2

[56] References Cited

U.S. PATENT DOCUMENTS

| | | | |
|---|---|---|---|
| 2,879,680 | 3/1959 | Beeman et al. | 81/57.18 |
| 3,180,186 | 4/1965 | Catland | 81/57.18 |
| 3,261,241 | 7/1966 | Catland | 81/57.18 |
| 4,084,453 | 4/1978 | Eckel | 81/57.18 |
| 4,089,240 | 5/1978 | Eckel | 81/57.18 |

*Primary Examiner*—James L. Jones, Jr.

*Attorney, Agent, or Firm*—Arnold, White & Durkee

[57] ABSTRACT

An open-mouth power tong of the type used to make up and break out threaded connections between tubular members includes an improved mechanism for properly aligning the pipe when it is gripped by the tong so that the pipe may be rotated evenly about its axis.

5 Claims, 6 Drawing Figures

36
R4
30
CL
P
70
P'
38
73
44
46
R2
A
A'
R2
X
50
58
56
B
B'
52
39
37
R3
R3
71
59
72

70
30
P
CL
P'
36
38
46
U
U
R2
44
X
50
R3
M,N
58
56
73
71
37
59
39
72

POWER TONG

This is a continuation of application, Ser. No. 6,905, filed Jan. 26, 1979, now abandoned.

BACKGROUND OF THE INVENTION

1. Field of the Invention

The present invention relates to power wrenches and more specifically to power tongs for making up and breaking out threaded connections between adjoining tubular members. In particular, the invention relates to a mechanism for bringing the gripping elements of an open mouth power tong into secure and uniform engagement with the pipe so that the pipe may be rotated evenly about its axis.

2. Description of the Prior Art

Oil field tubular members, e.g. drill pipe and casing, are employed in sections which are joined together at their ends by threaded connections. Power tongs of the type herein described are utilized to make and break out these threaded connections by securely gripping one tubular member and rotatably driving that member relative to the adjoining member.

Power tongs representative of present practice in the industry are described in U.S. Pat. Nos. 2,879,680; 3,180,186; 3,261,241 and 4,084,453. It has been found that the camming action typically used to bring the gripping elements or dies into contact with the pipe results in frequent misalignment of the pipe relative to the center of rotation of the tong. That is, the pipe often is not rotatably driven about its axis. This misalignment and the resultant vibrations place a severe limitation on the rotational speed which may be imparted to the pipe and, in extreme cases, may result in damage to the pipe or tong and a safety hazard to the operator. Thus, there is a need for a power pipe tong having means for securely and uniformly engaging the pipe in such a manner that the pipe may be rotated evenly about its axis.

SUMMARY OF THE INVENTION

In accordance with the present invention there is provided a novel power pipe tong having a pipe-gripping assembly for holding the pipe concentric with the rotary gear. In a particular embodiment the tong includes a frame having a throat at its front; a power driven rotary gear having a mouth adapted for alignment with the throat, the rotary gear being rotatably mounted on the frame; a pair of pivotally mounted jaws located on opposite sides of the centerline of the tong and having their pivot points rearward of the center of rotation of the rotary gear; a cam follower associated with each jaw; pipe gripping elements carried by the jaws; and at least one pair of opposed cam surfaces on the interior surface of the rotary gear, the cam surfaces of the pair being cooperatively shaped such that when the cam followers are cammed at points along the opposed cam surfaces the jaws are positioned so that a pipe section gripped therebetween is centered within the rotary gear.

In accordance with the invention there is also provided a novel rotary gear comprising means for being rotatably driven about a central gear axis by a suitable drive train; a central opening for housing a pipe section being gripped for rotation, the opening defining a gear interior surface; an aperture for aligning with the open-mouth of the tong during pipe loading and unloading; and at least one pair of diametrically opposed cam surfaces on the interior surface of the rotary gear, the cam surfaces being asymmetric with respect to the diametric line connecting the cam surfaces to compensate for the differferent angles at which the respective cam followers attack the two opposed cam surfaces during make up or break out operations.

Accordingly, a primary feature of the present invention is the provision of a power tong having means for bringing the gripping elements into secure and uniform engagement with the pipe so that the pipe may be rotated evenly about its axis to prevent dangerous vibrations. One aspect of this feature is the provision of opposed cam surfaces presenting different curvatures in order to compensate for the different angles at which the cam followers attack their respective cam surfaces during make up and break out operations.

These and other features and meritorious advantages of the present invention will become apparent upon consideration of the drawings and the accompanying detailed description of the preferred embodiment.

DETAILED DESCRIPTION OF THE PREFERRED EMBODIMENT

Figure 1:
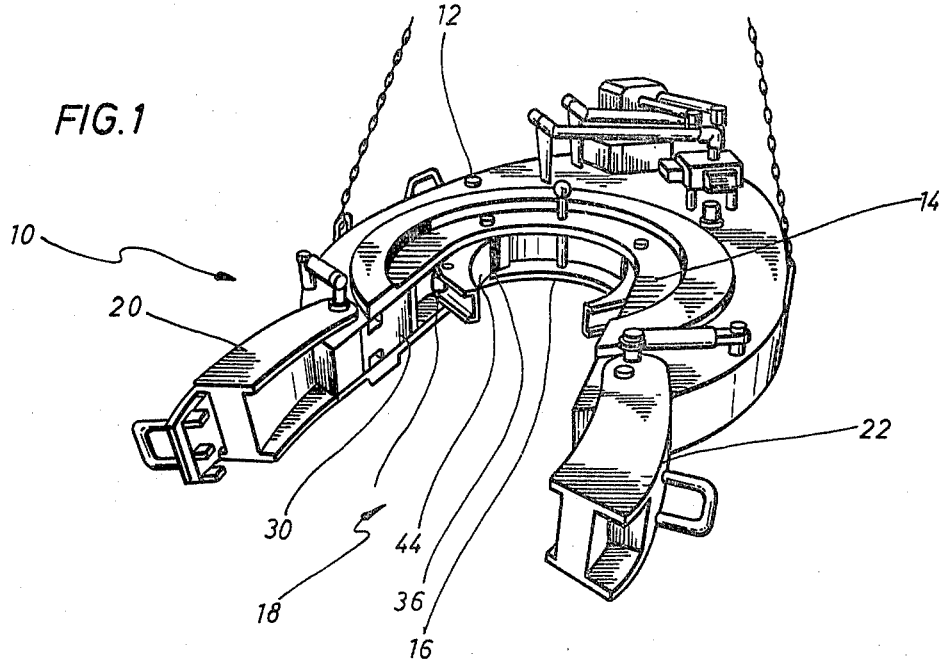
FIG. 1 is a perspective view of an open-mouth power tong constructed in accordance with the present invention.

Referring to the drawings and in particular to FIG. 1, there is shown in perspective an open-mouth power tong 10 constructed in accordance with the present invention. Tong 10 includes a frame 12 comprising upper and lower surfaces connected by sidewalls. The upper and lower surfaces further include upper and lower cage plates 14, 16 which pivotally support the jaws as explained below. Frame 12 defines a frontal throat 18 for receiving the pipe sections. When a pipe section is centrally located within the frame during operation, throat 18 is closed off by means of pivotally mounted door members 20, 22 in the manner well known in the art.

The pipe-gripping assembly will now be described with reference to FIGS. 1–3. A rotary gear 30 is mounted within frame 12 for rotation relative to the frame. Rotary gear 30 includes gear teeth (not shown) on its outer periphery so that it may be driven in the manner well known in the art, for example, by means of a plurality of pinion gears (not shown). The pinion gears, in turn, may be suitably driven by an hydraulic drive train as shown, for example, in U.S. Pat. No. 2,879,680. The inner surface of the rotary gear 30 includes cam means comprising curved cam surfaces 70, 71, 72, 73 for urging the pipe-gripping elements into contact with the pipe. In the illustrated embodiment, the pipe-gripping elements comprise dies 36, 37, 38, 39 mounted on a pair of pivotally mounted jaws 44, 46. The jaws are urged toward the pipe by means of cam followers comprising jaw rollers 50, 52 which are rotatably mounted on the jaws by pins 56, 58. Rollers 50, 52 ride on the cam surfaces 70, 71, 72, 73 on the interior of the rotary gear 30.

Figure 2:
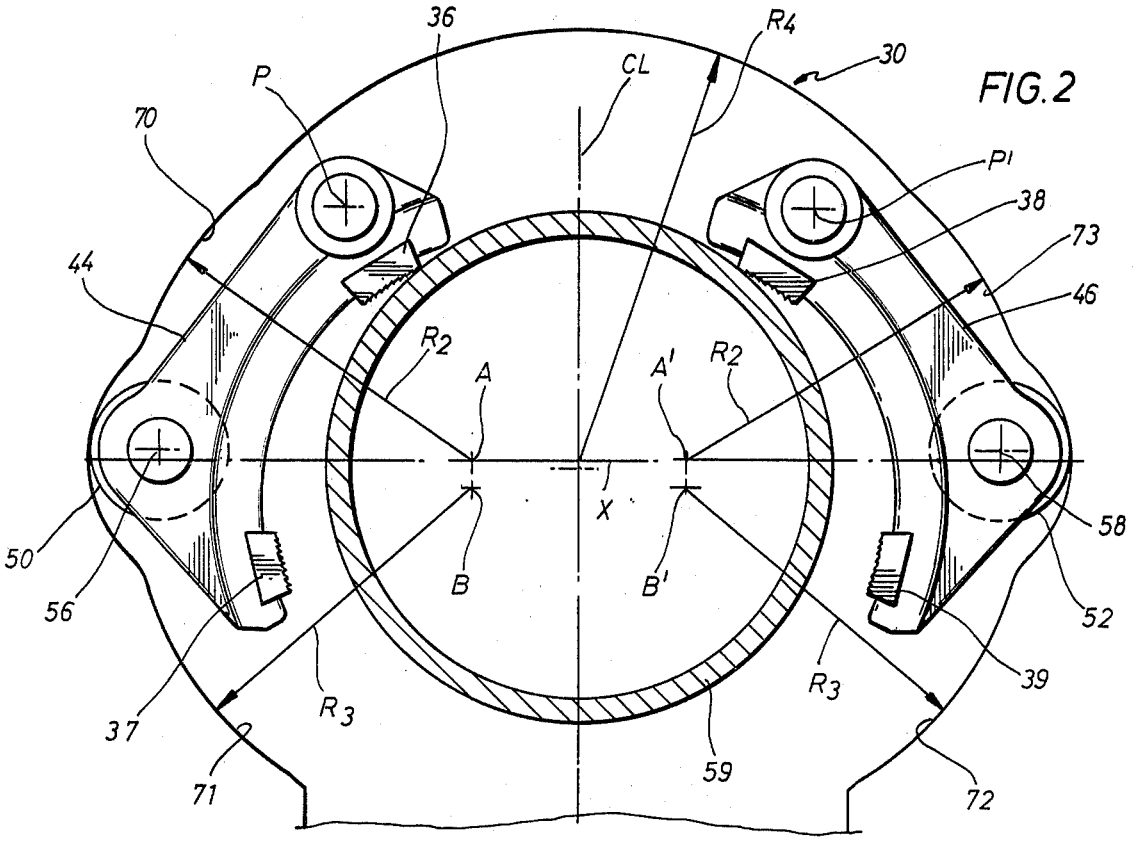
FIG. 2 is a plan view of the pipe-gripping assembly of the tong of the present invention, i.e., the jaws, jaw rollers, gripping dies, and interior surface of the rotary gear, with the jaws spread apart in a neutral position to receive a pipe.

It will be noted that the jaws are pivotally mounted at points P, P' toward the rear of the tong and that the rear dies 36, 38 are near the pivot points so that when a pipe section, for example, pipe section 59, is inserted in the tong, its rearward motion is stopped by dies 36, 38 as shown in FIG. 2. The front dies 37, 39 are positioned forward of line X (FIG. 2) which is the horizontal line that passes through the axis of rotary gear 30 and is perpendicular to the centerline, CL, of the throat. Thus, when the jaws are urged toward the pipe to the gripping position illustrated in FIG. 3, the front dies 37, 39 tend to urge the pipe somewhat rearwardly so that the pipe is gripped both forward and behind line X on both sides of the tong. Stated differently, the dies preferably grip the pipe in each of the four quadrants defined by lines X and CL. The rear dies 36, 38 are only slightly displaced during the gripping operation due to their proximity to the jaw pivot points P, P'. However, during the camming operation the angular attitude of rear dies 36, 38 changes substantially so that the dies contact the pipe at the correct biting angle.

As set forth above, the present invention relates primarily to improved means for bringing the dies into a gripping relation with the pipe in such a manner that the pipe is centered at the center of the rotary gear, thereby assuring relatively even and safe rotation of the pipe during make up and break out operations.

Figure 4:
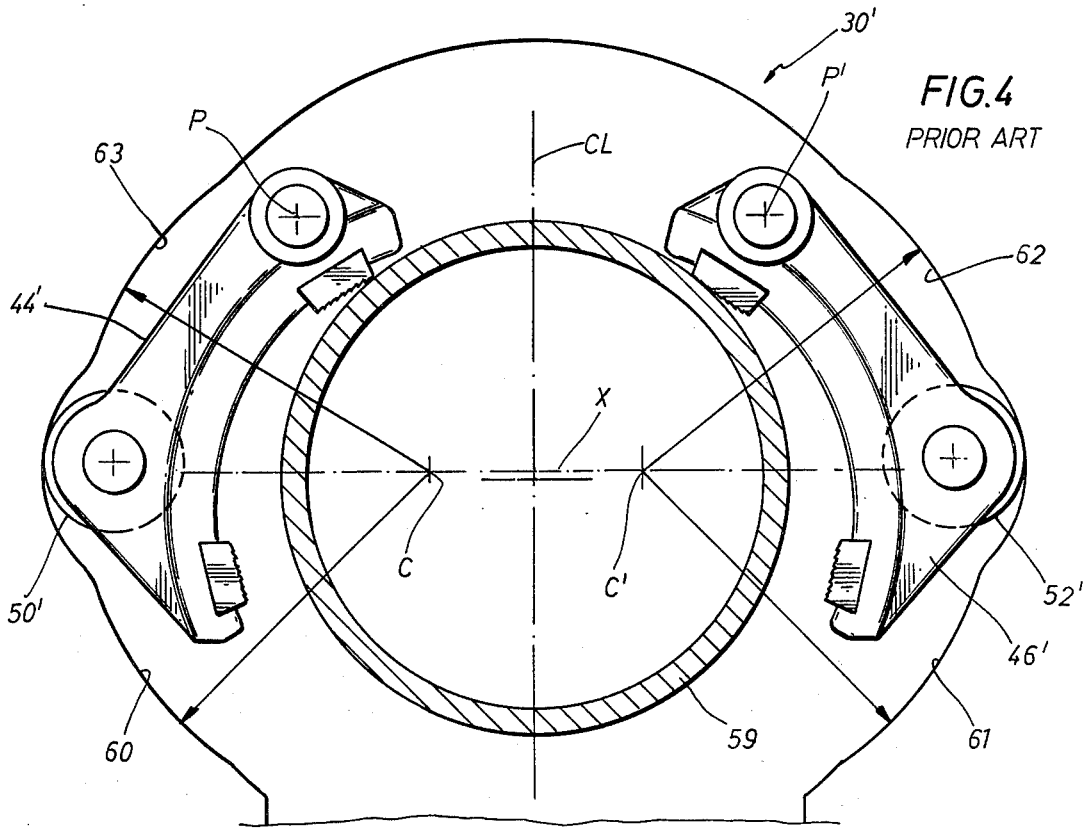
FIG.4 PRIOR ART
FIG. 4 is a view similar to FIG. 2 showing a typical prior art pipe-gripping assembly.
Figure 5:
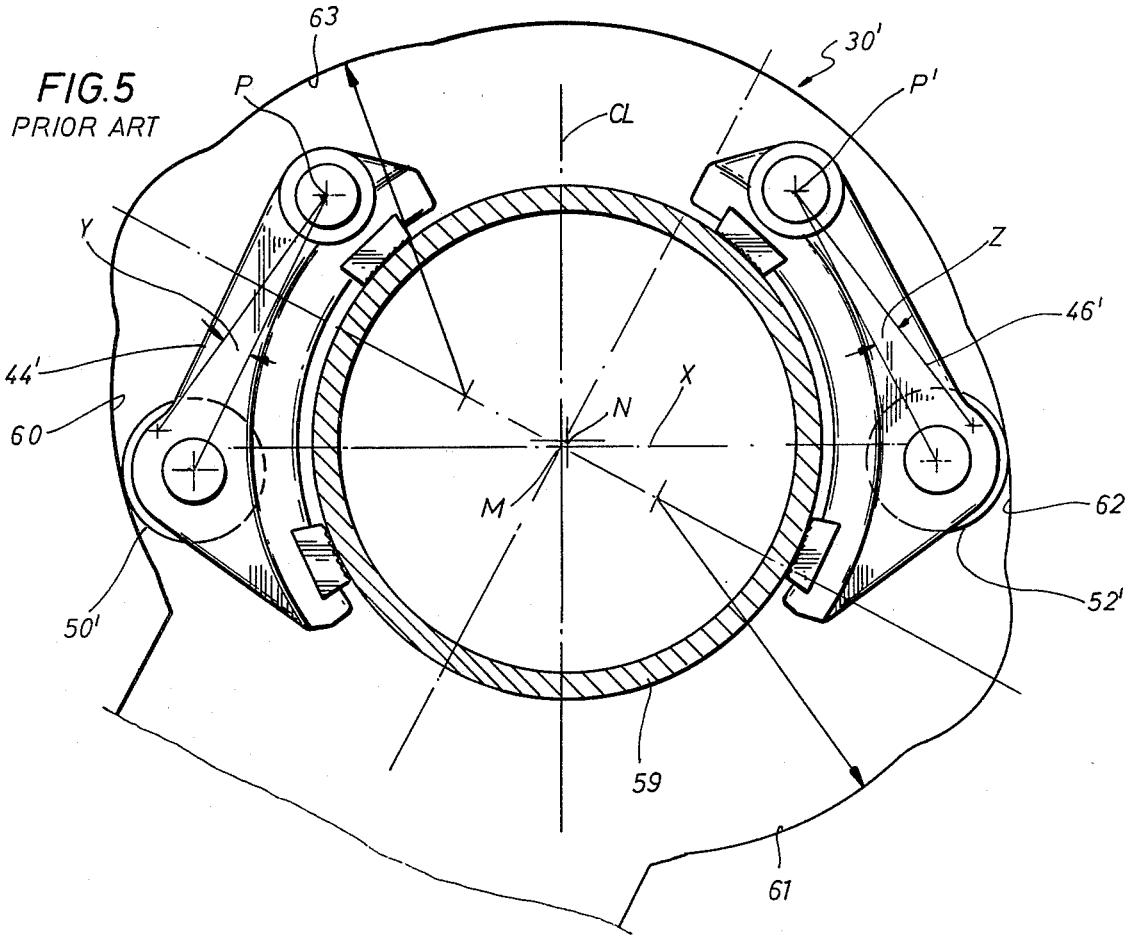
FIG.5 PRIOR ART
FIG. 5 is a view of the prior art assembly shown in FIG. 4 with the pipe gripped off-center.

The improvement of the present invention will be more readily understood after first analyzing a pipe gripping assembly of the prior art as illustrated in FIGS. 4 and 5. According to the illustrated prior art practice, the cam surfaces on the interior of the rotary gear 30' comprise opposed cam surface pairs 60, 62 and 61, 63. Cam surfaces 60 and 63 form portions of a circle having its center at point C on line X. Cam surfaces 61 and 62 form portions of a circle having its center at point C' on line X. The radii of the four cam arcs are equal; therefore, the curvature of the opposed pair of cams operating in any make up or break out operation will be equal. As discussed above, with the use of the symmetric pipe-gripping assembly illustrated in FIG. 4, the jaws 44', 46' must be urged toward the pipe evenly in order for the pipe to be centered as it is gripped. Stated differently, when the pipe is gripped the jaws must have been rotated the same angular amount around their respective pivot points. However, as shown in FIG. 5, when the pipe is gripped according to the illustrated prior art practice, the axis of the pipe is not at the center of the rotary gear. This occurs because the opposing jaw rollers 50', 52' are urged toward the pipe at different rates due to the fact that the opposed cam surfaces, e.g., cam surfaces 60 and 62, are acting on their respective jaw rollers at different "angles of attack". This phenomenon may be best understood by visualizing the movement of the opposed cam surfaces, e.g. cam surfaces 60 and 62, during a typical make up operation. As the operation begins, the jaw rollers 50', 52' are positioned within the neutral recesses on the opposite sides of the rotary gear. As the rotary gear begins to move, for example in a clockwise direction to the pipe-engaging position illustrated in FIG. 5, cam surface 60 moves closer to the pivot point P of its respective jaw while cam surface 62 moves away from the pivot point P' of its jaw, thereby causing the rollers to act on different effective cam pitches. Therefore, the jaw rollers 50', 52' are urged toward the pipe at different rates since the effective pitches of the cam surfaces are different. During a subsequent break out operation, the other pair of opposed cam surfaces, i.e. cam surfaces 61 and 63, will act in a similar manner such that the pipe will be gripped in an off-center manner.

The amount of angular motion of jaws 44', 46' is shown in FIG. 5 where the initial positions of the centers of the jaw rollers 50', 52' are shown as cross marks. As illustrated, jaw 44' moves through an angle Y about its pivot point P while jaw 46' moves through an angle Z about its pivot point P'. Since angle Y is somewhat greater than angle Z, pipe 59 is gripped in the slightly off-center position shown in FIG. 5, where reference character M represents the center of rotation of the rotary gear 30 and N represents the axis of the pipe. As explained below, a primary object of the present invention is to assure that points M and N more nearly coincide.

Figure 3:
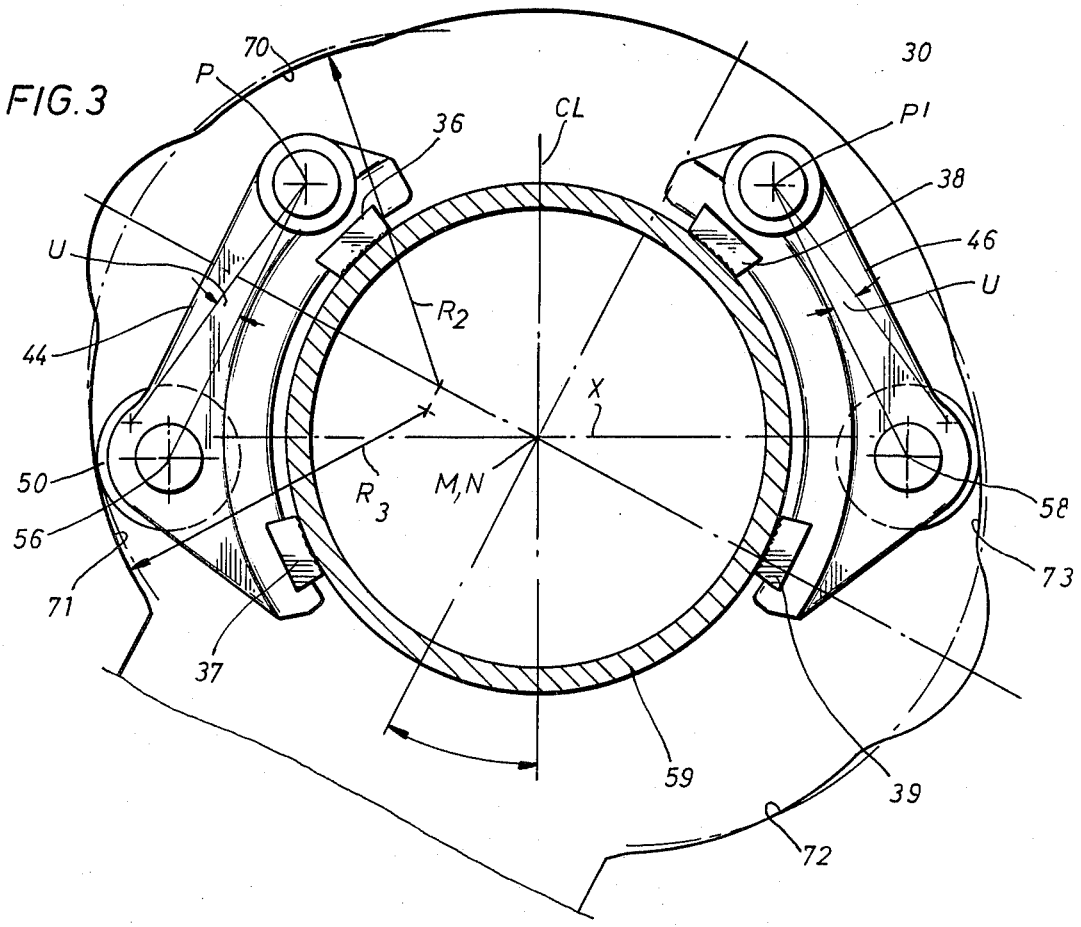
FIG. 3 is a view similar to FIG. 2 showing the pipe securely held by the pipe-gripping assembly with the axis of the pipe at the center of the rotary gear.

According to the apparatus of the present invention illustrated in FIGS. 2 and 3, the opposing cam surface pairs, i.e. pairs 70, 72 and 71, 73, are not of equal curvature. As best shown in FIG. 2, cam surfaces 70 and 73 define portions of circles having equal radii $R_2$ with their centers at points A, A' on line X. Cam surfaces 71, 72 define portions of circles having equal radii $R_3$ with their curvatures at points B, B' which are offset from line X. In the illustrated embodiment, the radii $R_3$ are slightly less than the radii $R_2$. In a particular embodiment of a rotary gear for use on a $7\frac{5}{8}$ inch tong, the nominal radius $R_4$ of the rotary gear is $6\frac{3}{8}$ inches, $R_2$ is 5.26 inches and $R_3$ is 5.06 inches with points B, B' being offset from line X at a distance of approximately 0.40 inch.

The operation of the illustrated pipe-gripping assembly can be best appreciated with reference to FIGS. 2 and 3. In FIG. 2 the jaw rollers 50, 52 rest in the neutral recesses as the pipe is received by the tong and moved into contact with the back dies 36, 38. As the rotary gear is rotated in a clockwise direction to the pipe-gripping position shown in FIG. 3, jaw rollers 50, 52 ride along their respective cam surfaces 71, 73 to urge the dies into gripping contact with the pipe. Because cam surface 71 is moving toward the pivot point P of its respective jaw 44, the camming effect of this cam surface would be somewhat less than that of its opposed cam surface if the two cam surfaces were identical. However, as illustrated in FIGS. 2 and 3, cam surface 71 has a greater curvature than cam surface 73 so that jaw rollers 50, 52 ride along cams of equal effective pitch thereby enabling jaw 44 to approach the gripping position of FIG. 3 at the same rate as jaw 46.

As shown in FIG. 3, when moving from the neutral position to the engaged position, both jaw rollers 50, 52 move through an angle U, thereby causing the center of rotation of the rotary gear, M, to lie on the axis of the pipe, N.

Figure 6:
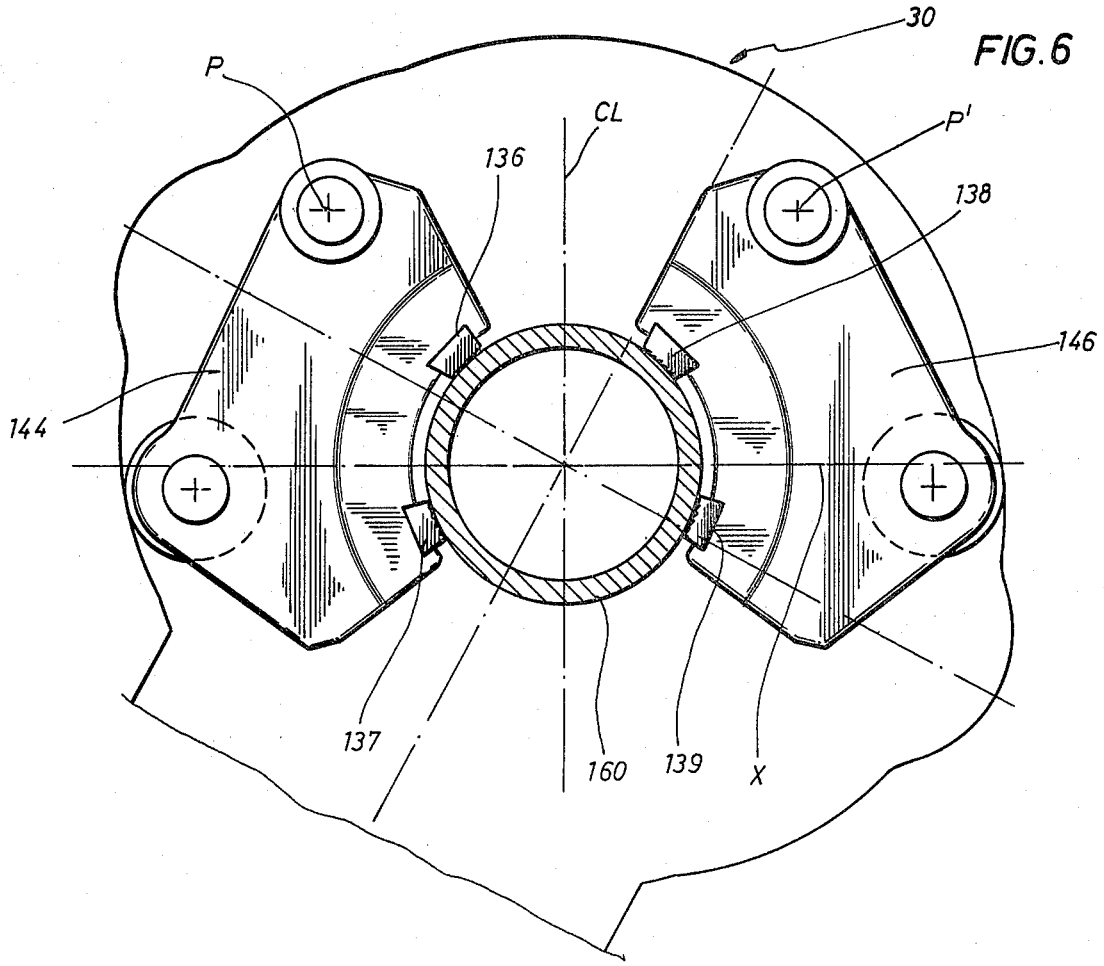
FIG. 6 is a view of a pipe-gripping assembly of the present invention showing enlarged jaws used for gripping pipe of relatively small diameter.

The common practice in the art is to provide a single tong which may be used for a wide range of drill pipe and casing diameters. In order to achieve this flexibility, each tong is provided with a different pair of jaws for each size pipe to be gripped. FIG. 6 illustrates the same power tong gripping assembly as shown in FIGS. 2 and 3 except that jaws 44, 46 have been replaced with substantially larger jaws 144, 146 having dies 136, 137, 138, 139 which are adapted to grip a smaller pipe 160. The rotary gear 30 is the same. The jaws are made interchangeable by removal of the jaw retention bolts at pivot points P and P'. According to the present invention, each pair of jaws, e.g. jaws 144, 146, are preferably constructed such that their dies will grip the pipe for which they are designed with the jaw rollers at approximately the same point on the cam surfaces. Thus, it can be seen that the improved cam surface configurations of the present invention provide the stated advantages for any size jaw used in the tong.

It will be appreciated that the positions of the jaw rollers on the cam surfaces when the pipe is gripped will vary where the pipe is either undersized or oversized. However, within reasonable pipe diameter tolerances, the cam surfaces are long enough so that even undersized or oversized pipe will be gripped with the jaw rollers somewhere along the cam surfaces. Therefore, the gripping may occur with the jaw rollers at any point along some discrete length, for example, a length on the order of 2 to 3 inches. As used herein, the term "cam surface" refers to that discrete length along which the gripping camming action may be expected to take place. The adjacent regions on the interior of the rotary gear may be curved or otherwise shaped to smoothly bring the cam follows (jaw rollers) to the cam surfaces, but the term "cam surface" refers only to that length along which gripping camming action occurs between the cam followers and the interior surface of the rotary gear. It is desired that the opposing jaws 44, 46 be displaced equally (i.e. moved through equal rotational angles about points P, P') whenever the jaw rollers are positioned anywhere along the cam surfaces. It can be seen that for any chosen shape of a cam surface used on rotary gear 30, there is a unique configuration for its opposing cam surface that will assure that the opposing jaws move toward the pipe at the same rate. The foregoing statement applies to the usual situation where there is symmetry about line CL, i.e. where the jaw sizes and shapes are the same, the dies the same and the pivot points P, P' are located in mirror positions relative to line CL. Where there is not precise symmetry about line CL, there is, nevertheless, a unique configuration for the opposing cam surface that will give the advantages of the present invention. But the configuration will be different from the situation where there is symmetry.

It will be appreciated that the precise cam arrangements illustrated in FIGS. 2 and 3 are illustrative only. Other cam configurations may be devised. What is important is that the opposing cam surfaces be cooperatively shaped such that when the cam followers (jaw rollers) are at any two given points along the opposing cam surfaces, the opposed jaws will have moved to positions such that a pipe gripped therebetween will be centered within the rotary gear. In the usual case where there is symmetry about line CL, the jaws will have moved through the same rotational angle about their respective points at any time the jaw rollers are on the cam surfaces.

While the present invention has been disclosed in conjunction with illustrative embodiments, numerous modifications may be made without departing from the spirit or scope of the invention.

What is claimed is:

1. An open-mouth power tong comprising:

a frame having a throat at its front;

a power-driven rotary gear having a mouth adapted for alignment with the throat, said rotary gear being rotatably mounted on the frame;

a pair of pivotally mounted jaws located on opposite sides of the center line of the tong and having their pivot points rearward of the center of rotation of the rotary gear;

a cam follower associated with each jaw;

pipe gripping elements carried by the jaws; and at least one pair of opposed cam surfaces on the interior surface of the rotary gear, the cam surfaces of the pair being cooperatively shaped such that when the cam followers are cammed at points along the opposed cam surfaces the jaws are positioned so that a pipe section gripped therebetween is centered within the rotary gear;

said at least one pair of opposed cam surfaces comprising a first cam surface defined by a portion of a first circle having its center on the line X which is perpendicular to the centerline of the throat and passes through the center of the rotary gear, and a second cam surface defined by a portion of a second circle having a smaller radius than the first circle, with the center of the second circle located at the opposite side of the throat centerline and being offset from line X.

2. A power tong as claimed in claim 1 wherein said pair of jaws are pivoted at points symmetrically located about the centerline of the tong and the jaws and their associated pipe gripping elements are substantially the same shape and size, and wherein the opposed cam surfaces are cooperatively shaped such that when the cam followers are cammed at points along the opposed cam surfaces the opposed jaws will have pivoted toward the pipe section through substantially the same angle.

3. A power tong as claimed in claim 1 including two pairs of opposed cam surfaces, a first pair for joint make up and a second pair for joint break out.

4. In a power tong of the type having a frame with a pipe-receiving throat, a rotary gear mounted on the frame, means for rotatably driving the rotary gear, cam means on the inner surface of said rotary gear comprising two pairs of opposed cam surfaces, a pair of pivotally mounted jaws carrying dies for biting into the exterior of the pipe, and a cam follower associated with each jaw for riding on said cam surfaces and urging the dies into biting engagement with a pipe section, improved cam means wherein each pair of opposed cam surfaces comprises first and second diametrically opposed cam surfaces, said first opposed cam surface being defined by a portion of a first circle having its center on the line X which is perpendicular to the centerline of the throat and passes through the center of the rotary gear, and said second opposed cam surface being defined by a portion of a second circle having a smaller radius than the first circle, with the center of the second circle located at the opposed side of the throat centerline and being offset from line X.

5. A rotary gear for use in a power tong of the type having opposed jaws pivotally mounted for being brought into gripping engagement with a pipe section by operation of cam followers adapted to ride on cam surfaces on the interior surface of a rotary gear, said rotary gear comprising:

means for being rotatably driven about a central gear axis by a suitable drive train;

a central opening for housing a pipe section being gripped for rotation, said opening defining a rotary gear interior surface;

an aperture for aligning with the mouth of the tong during pipe loading and unloading; and at least one pair of diametrically opposed cam surfaces on the interior surface of the rotary gear, said first opposed cam surface being defined by a portion of a first circle having its center on the line X which is perpendicular to the centerline of the throat and passes through the center of the rotary gear, and said second opposed cam surface being defined by a portion of a second circle having a smaller radius than the first circle, with the center of the second circle located at the opposite side of the throat centerline and being offset from line X.

* * * * *